US005941187A

United States Patent [19]

Rouleau et al.

[11] Patent Number: 5,941,187

[45] Date of Patent: Aug. 24, 1999

[54] DEVICE FOR GUIDING A SEWN MATERIAL PERPENDICULARLY TO A PRESSER FOOT, AUTOMATIC SEWING METHOD AND SEWING MACHINE

[76] Inventors: Patrick Rouleau, 52 boulevard Carnot; Alain Rouleau, 3 rue Espinasse, both of 31000 Toulouse; Jean-Pierre Touret, Route de Merville, Bretx, 31530 Levignac, all of France

[21] Appl. No.: 09/011,616

[22] PCT Filed: Jun. 13, 1997

[86] PCT No.: PCT/FR97/01079

§ 371 Date: Feb. 10, 1998

§ 102(e) Date: Feb. 10, 1998

[87] PCT Pub. No.: WO97/47797

PCT Pub. Date: Dec. 18, 1997

[30] Foreign Application Priority Data

Jun. 14, 1996 [FR] France ..... 96.07591
Jun. 14, 1996 [FR] France ..... 96.07592

[51] Int. Cl.[6] ..... D05B 21/00; D05B 27/14

[52] U.S. Cl. ..... 112/475.03; 112/153; 112/306; 112/320; 112/470.07; 271/227

[58] Field of Search ..... 112/470.07, 475.03, 112/318, 322, 320, 153, 306, 309, 308; 271/227, 251, 225

[56] References Cited

U.S. PATENT DOCUMENTS 3,598,070 8/1971 Rosenberg .
4,455,954 6/1984 Franck, III et al. ..... 112/306 X
4,813,364 3/1989 Boser .
4,836,119 6/1989 Siraco et al. ..... 112/306
5,054,409 10/1991 Schips ..... 112/320 X
5,493,980 2/1996 Nishimori et al. .
5,497,720 3/1996 Kawasaki ..... 112/153

FOREIGN PATENT DOCUMENTS 0 216 644 4/1987 European Pat. Off. .
0 468 578 1/1992 European Pat. Off. .
2392909 12/1978 France .
2585683 2/1987 France .
37 12 493 11/1987 Germany .

*Primary Examiner*—Peter Nerbun
*Attorney, Agent, or Firm*—Young & Thompson

[57] ABSTRACT

A device and method of guidance equipping a sewing machine provided with a work carrier plate, and a presser foot (5) for driving the material to be sewn, associated with at least one needle comprising at least one member (10) for adjusting the transverse position of the material, applied in contact with the material at a point of contact (12): offset laterally from a driving straight line (18); situated in operation at least substantially in line with the presser foot (5) and oriented with a fixed non-zero angle with respect to the driving straight line. A machine equipped with this device is also disclosed.

23 Claims, 8 Drawing Sheets

DEVICE FOR GUIDING A SEWN MATERIAL PERPENDICULARLY TO A PRESSER FOOT, AUTOMATIC SEWING METHOD AND SEWING MACHINE

FIELD OF THE INVENTION

The invention concerns a device for guiding flexible textile material (woven or knitted fabric etc) able to be sewn on a sewing machine of the traditional type comprising a work carrier plate and a claw mechanism for advancing the material, associated with at least one needle; hereinafter this mechanism and its accessories will be designated by the expression "presser foot". The invention extends to a method for the automatic sewing of material, implemented by means of a sewing machine equipped with such a guidance device. It also extends to improved sewing machines equipped with one or more guidance devices according to the invention.

BACKGROUND OF THE INVENTION

In making up, the operations of sewing pieces of woven or knitted fabric generally aim to sew two pieces together along one of their edges or to form a hem at the border of one piece, or again to fix a tape, a piece of elastic, a waistband etc along one edge of a piece. In order to attempt to save on labour and make gains in productivity, guidance systems have been proposed which move the woven or knitted fabric in the transverse direction upstream of the needle in order to constantly bring the area to be sewn facing the needle; these systems generally comprise wheels or caterpillars with rollers, disposed in the transverse direction upstream of the needle in the direction of driving, and which are driven in rotation in one direction or the other so as to be able to move the material transversely (at right angles to the direction of driving) in both directions in order to make suitable position corrections. However, these systems are little used since they result in imperfect sewing and frequent defects. This is because the flexible material driven by the presser foot level with the needle is braked upstream of the latter by the guidance system and has a tendency to roll on itself, to become folded or to wrinkle in a random fashion, which is incompatible with obtaining an even quality stitching; this defect is particularly serious for stretch or "soft mesh" knitwear which it is impossible to sew with these known systems; in the case of two pieces to be joined edge to edge; offsets of one edge with respect to the other occur, and joining imperfections which are prejudicial to the quality of the product produced. In addition, the majority of existing systems can be used only for materials with a defined thickness.

Subsequently (patents FR 2 585 683 and EP 0 216 644), a guidance device was proposed which comprises a spherical wheel coming into abutment against the material upstream of the presser foot and turning in a single direction of rotation in order to drive and guide the material upstream of the stitching area. This device has a radically different principle from the other prior systems since, in these patents, the spherical wheel is offset laterally, drives the material in the same direction as the presser foot, but is mounted so as to pivot about a vertical axis so as to be able to orient it by virtue of a control of the proportional analogue type in different driving directions enabling the material to be brought into the required position. In the device to which these patents relate, the spherical wheel is driven in rotation by friction by means of a roller which comes into abutment on one side thereof in the horizontal plane containing the axis of the wheel.

However, such a system comes up against a serious practical difficulty in implementation. To afford satisfactory driving of the spherical wheel by means of the roller, it is necessary for the surfaces of these components to roll without sliding against each other and therefore to have a sufficient coefficient of friction; when the spherical wheel pivots about the vertical axis in order to adopt another orientation, the abutment of the roller on this wheel describes a segment of a great circle and this movement is transverse with respect to the roller (parallel to the axis of the roller and perpendicular to the tangential velocity), so that the friction of the two surfaces has a tendency to oppose the movement. Under these circumstances, the pivotings of the spherical wheel in order to modify its orientation require the involvement of high forces, must be slow compared with the speeds of rotation of the roller and of the wheel, and produce rapid wear on the surfaces which requires frequent changes of these components.

In order to mitigate these drawbacks, EP-A-0 468 578 next proposed a guidance device on which the roller is positioned above a rotating component for adjustment by driving the material (elastic sphere) so as to come into abutment with the upper area of the component turning in the opposite direction to the area of contact of the component with the material, the area of abutment of the roller with the rotating component being situated substantially on the vertical axis about which the pivoting of the said rotating component takes place. Thus the material is longitudinally driven by the rotating component, in a permanent fashion, at a point of contact situated on the driving straight line upstream of the presser foot, and the position corrections are made by orienting the direction of this driving in a suitable fashion.

This system gives satisfaction but is nevertheless limited to the guidance of pieces parallel to reference lines whose radius of curvature is large, notably greater than approximately 25 cm. Thus this system is not in practice sufficiently rapid and effective for producing automatic stitching parallel to lines having portions with a very pronounced curvature (radius of curvature less than 25 cm), or even angular. Such stitches must therefore still be produced manually by operators who guide the material in front of and upstream of the needle.

It should be noted that, in the known guidance devices, up to now attempts have been made to automate the action of the operator by guiding the material immediately upstream of the needle. Thus, in all the above-mentioned guidance devices with a spherical rotating component, the position of the material is adjusted by varying the angle of orientation of the axis of rotation of the rotating component in one direction or the other.

In addition, it has up till now been considered inevitable, in these prior devices, for the guidance of the material not to be able to be provided continuously between the adjustment component and the presser foot, that is to say over a distance which may extend in practice over several centimeters.

Moreover, FR-2 392 909 describes a device comprising several rollers rotating about a common fixed axis perpendicular to the driving direction and passing through the needle. The different motors of the different rollers are controlled by an analogue control which applies to them voltages such that the centre of pivoting applied by all these rollers coincides with the centre of curvature of the border of the piece of cloth being stitched. This device is conceivable only with wide pieces and results in practice in many phenomena of unwanted folds, notably in the case of flexible or stretch fabrics. In addition, it is complex, extremely tricky, if not impossible, to adjust satisfactorily, and requires adjustments at each change of fabric and/or shape of piece.

U.S. Pat. No. 4,813,364 describes an endless band disposed laterally in contact along a linear contact surface parallel to the direction of driving. Such a device is completely ineffective in practice since the band in contact with the fabric prevents any pivoting or causes significant folds in the fabric.

SUMMARY OF THE INVENTION

The invention therefore aims to resolve these drawbacks by proposing a device for guiding a material to be sewn parallel to a reference line, notably an edge of the material, which can have any curvatures, and in particular high curvatures or even angles. The invention relates in particular to the effecting of automatic stitching which can have radii of curvature appreciably less than 25 cm, and which can notably take any value between one centimeter or a few centimeters, and 25 centimeters.

The object of the invention is the mounting of one or more of these improved devices on a sewing machine of a known type (provided with a work support plate and a presser foot associated with at least one needle) with a view to making it possible to sew pieces of material automatically, parallel to a predefined reference line, consisting in particular of an edge of the pieces. The invention applies whatever the purpose of the stitching: stitching of a tape, a waistband, a piece of elastic at the edge of the piece, stitching of a hem (the machine being provided with a conventional device for folding the material), the stitching of two pieces together (the machine being provided with two guidance devices) etc.

The purpose of the invention is to make it possible to obtain an even stitch of good quality, at a high rate, including in the case of high curvatures, whatever the material (notably fine woven or knitted fabrics which are difficult to handle, stretch materials etc), and avoiding the difficulties of implementation (such as the phenomena of unwanted folds) encountered by the prior devices.

Another purpose is to provide a guidance device with a simple structure which, mounted on a sewing machine of a traditional type, makes it possible to produce automatic stitches on materials of any thicknesses, parallel to any lines, with pieces of any shapes. Thus the invention aims more particularly to propose a guidance device making it possible to produce both concave and convex curvatures (that is to say in both directions).

The invention also aims to propose such a device which does not require complex adjustments at each change of material and/or shape of piece, and therefore is highly multipurpose.

The invention also aims more particularly to propose a guidance device making it possible to guide the material from the very start of the stitching until the end of the stitching of the piece of material.

The invention aims in particular to propose a guidance device allowing the automatic stitching of undergarments (G-strings, brassieres, tank-tops, tee-shirts, briefs, etc).

Certain terms used hereinafter, with a view to simplifying terminology and making the description clearer, are defined below:

"material": any flexible textile material in sheet form, including woven, knitted etc material able to be sewn, "longitudinal" direction: direction of the desired sewing line, "transverse" direction: direction at right angles to the longitudinal direction, "vertical" direction: direction orthogonal to the sheet of material (or to the work carrier plate of the sewing machine, which carries the material), level with the presser foot, "horizontal" direction: direction parallel to the sheet of material (or to the work carrier plate of the sewing machine), level with the presser foot, "presser foot": the entire conventional mechanism providing the guidance and advance of the material level with the needle, "upstream" and "downstream" are used with reference to the direction of driving of the piece of material by the presser foot, "in line with . . . ": aligned in a transverse direction with . . . , "driving straight line": straight line parallel to the longitudinal direction of driving by the presser foot and passing through the presser foot.

The invention therefore concerns a method for the automatic stitching of a piece of flexible textile material (woven, knitted etc) by means of a sewing machine, in which at least one rotary adjustment member is applied continuously in contact with the material at at least one point of contact on the material offset laterally from the driving straight line, wherein the adjustment member is applied at at least one point of contact situated, in operation, at least substantially in line with the presser foot, and wherein the adjustment member is mounted and applied and is kept continuously applied in contact with the material so that, in operation, a plane perpendicular to the work carrier plate at the point of contact and which contains the direction of the peripheral speed V1 of the adjustment member at the point of contact, forms, with a plane perpendicular to the work carrier plate at the point of contact and parallel to the driving straight line, a non-zero fixed orientation angle $\alpha$.

According to the invention, the orientation angle $\alpha$ is less than 90°, notably between 20° and 45°.

Advantageously, and according to the invention, the adjustment member is mounted on the machine and is applied at a point of contact situated so that a vertical plane which contains a straight line passing through the point of contact and through the entrance to the presser foot forms an angle $\beta$ of around 90° with a vertical plane which contains the driving straight line.

The invention also concerns a method in which the transverse position of a predetermined reference line of the material is detected in a detection area upstream of the presser foot and a position signal is generated whose value varies according to whether said predefined reference line is on one side or the other of a straight line, referred to as the detection line, passing through the detection area and parallel to the driving straight line, wherein:

the adjustment member is put and maintained in one of the following two states, depending on the value of the position signal: a state of being driven in rotation in the direct direction; and a braked state, in the state of being driven in the direct direction, the adjustment member is driven at a speed corresponding to a peripheral speed V1 of the adjustment member at the point of contact which is greater than the component V2", at the point of contact and in the direction of said peripheral speed V1, of the speed V2 at which the material is driven by the presser foot, in the braked state, the driving of the adjustment member is controlled so that said peripheral speed V1 is less than or in the opposite direction to said component V2" of the speed V2 at which the material is driven by the presser foot, the adjustment member is put and maintained in the state in which it is driven in rotation in the direct direction when said point of contact and said predefined reference line are on each side of a straight line, referred to as the detection line, passing through the detector and parallel to the driving straight line, whereby the material is accelerated, at said point of contact, by the adjustment member, and therefore driven pivotally in a direction F1 with respect to the work carrier plate, and the adjustment member is put and maintained in the braked state when said point of contact and said predefined reference line are situated on the same side of the detection line, whereby the material is braked, at said point of contact, by the adjustment member, and therefore driven pivotally in the other direction F2 with respect to the work carrier plate.

The method according to the invention is more particularly applicable to the execution of the automatic stitching of a piece of material along one of its edges constituting a predefined reference line, and is characterised in that:

the presence or absence of material is detected in at least one detection zone situated immediately upstream, and preferably in the immediate vicinity of the presser foot, on the predicted path of the edge to be detected, a position signal is generated with two states representing the presence or absence of material, the change of state of the adjustment member is controlled alternately from the state in which it is driven in the direct direction to the braked state, or vice versa, according to the state and at each change of state of the position signal.

With a method according to the invention, convex and concave curves are produced equally well and guidance is provided as far as the end of the piece of material. In addition, adjustment of the material is effected on the portion of material engaged in the presser foot and is controlled by a detection effected immediately upstream and in the vicinity of the presser foot, so that any area where there is no guidance of material upstream of the presser foot is eliminated and the reaction times are more rapid.

Thus, although the adjustment member is not upstream of the presser foot, which was considered essential in the devices of the prior art (in which the principle was to guide the piece of material before it passes underneath the presser foot), with the invention guidance is obtained over all the material entering the presser foot with greater efficacy and greater precision at the presser foot.

In addition, according to the invention, it is the position of the portion of the reference line which passes in line with the detection zone which is used to determine whether the adjustment member is put in one or other of the states. In addition, when this portion of the reference line passes exactly over the detection zone and coincides with the detection line, it can be chosen to put and maintain the adjustment member in one or other of the two states. For example the state of being driven in the direct direction is chosen.

Although the point of contact of the adjustment member is not positioned on the driving straight line and the orientation of the adjustment member remains fixed, it has become clear that, with a simple control of the two-state type effected continuously and at high frequency, adjustment and guidance of great precision is obtained along curves which can be of very high curvature, or even angular. Several explanations can be advanced for the observation of this result: the pivoting torque induced by the guidance device is at least approximately proportional to the distance between the point of contact and the entrance to the presser foot, a distance which may be great and no longer impairs the efficacy of the guidance as in the prior devices; two distinct phenomena are used respectively in the two states: in the braked state, it is the presser foot itself which generates the pivoting of the material about a centre of rotation which passes through the point of contact, and in the state in which it is driven in the direct direction the pivoting is due to the difference in speed between the driving of the material at the point of contact by the adjustment member and the driving of the material at the presser foot; the non-zero fixed orientation angle $\alpha$ continuously draws out the material laterally between the point of contact and the presser foot, which considerably increases the dynamic performance whilst preventing any unwanted and undesirable phenomenon (folding, wave effects, etc).

In the braked state, it suffices for the adjustment member to exert a braking of the material at the point of contact for the latter to pivot. Advantageously, and according to the invention, the adjustment member is locked in order to stop it in the braked state. In fact a stop command is particularly simple and rapid to implement.

If an increased efficacy of pivoting (that is to say a smaller radius of curvature) is desired, it is even possible to drive the adjustment member in the retrograde direction (opposite to the direct direction) in the braked state. In this case, the material is caused to draw back locally at the point of contact.

Advantageously and according to the invention, in order to control the operation and the state of the adjustment member, a drive motor is controlled in two-state mode, by applying to it either a signal for driving in the direct direction or a braking signal, depending on whether or not the presence or absence of material is detected.

The invention also concerns a material guidance device for the purpose of implementing the method according to the invention.

The invention thus concerns a device for guiding flexible textile material (woven, knitted etc) able to be sewn, equipping a sewing machine provided with a work carrier plate, and a presser foot for driving the material in a longitudinal driving direction and associated with at least one needle, with a view to permitting the execution of an automatic stitching of the material, this guidance device comprising:

at least one member for adjusting the transverse position of the material, mounted so as to rotate and so as to be able to come into contact with the material, and adapted to be able to locally modify the speed of driving of the material when it is applied to the material, means of applying the adjustment member continuously in contact with the material at a point of contact offset laterally from a straight line, referred to as the driving straight line, passing through the presser foot and parallel to the longitudinal direction of driving, wherein the application means are adapted and the adjustment member is mounted so that:

the point of contact is situated, in operation, at least substantially in line with the presser foot, in operation, a plane perpendicular to the work carrier plate at the point of contact and which contains the direction of the peripheral speed V1 of the adjustment member at the point of contact, forms, with a plane perpendicular to the work carrier plate at the point of contact and parallel to the driving straight line, a non-zero fixed orientation angle $\alpha$.

Advantageously and according to the invention, the orientation angle $\alpha$ is less than 90°, notably between 20° and 45°.

The expression "at least substantially in line with the presser foot" means that the point of contact is situated on a zone which is neither totally upstream nor totally downstream of the presser foot. In other words, a plane perpendicular to the work carrier plate and in the direction of driving and which contains the point of contact, passes through the presser foot.

Advantageously and according to the invention, the adjustment member is also applied and mounted so that a plane which contains a straight line passing through the point of contact and through the entrance to the presser foot forms an angle $\beta$ of approximately 90° with a vertical plane which contains the driving straight line.

In addition, the device according to the invention advantageously comprises means of prior setting of the position of the adjustment member with respect to the presser foot.

The guidance device according to the invention is applicable advantageously for executing an automatic stitching of a piece of material along a predefined reference line, for example along one of its edges. It then has:

means of driving, from a driving movement generated by a motor, the adjustment member in rotation at least in one direction, referred to as the direct direction, for which the peripheral speed V1 of the adjustment member at the point of contact has a component V1' in the driving direction which is oriented in the direction of driving of the material by the presser foot, a detector detecting the transverse position of the predefined reference line—notably in the form of a detector for the presence or absence of material associated with means of generating a position signal whose value varies depending on whether said predefined reference line is on one side or the other of a straight line, referred to as the detection line, passing through the detector and parallel to the driving straight line.

The device according to the invention is characterized:

in that the driving means are adapted so as to be able to drive the adjustment member in the direct direction at a peripheral speed V1 of the adjustment member at the point of contact which is greater than the component V2", at the point of contact and in the direction of the peripheral speed V1, of the speed V2 of driving of the material by the presser foot, in that the means of driving the adjustment member are adapted to put and maintain the adjustment member in one of the following states: a state, referred to as the state of being driven in the direct direction, in which it is driven, at said peripheral speed V1, in the direct direction by the driving means; and a state, referred to as the braked state, in which the peripheral speed V1 is less than or in the opposite direction to the component V2" of the speed V2 of driving of the material by the presser foot, and in that it has control means of the two-state type adapted to control the driving means as a function of the value of the position signal:

in the state in which the adjustment member is driven in the direct direction when said point of contact and said predefined reference line are on each side of the detection line, whereby the material is accelerated, at the point of contact, by the adjustment member and therefore driven pivotally in a direction F1 with respect to the work carrier plate, in the braked state of the adjustment member when said point of contact and said predefined reference line are situated on the same side of the detection line, whereby the material is braked, at said point of contact, by the adjustment member and therefore driven pivotally in the other direction F2 with respect to the work carrier plate.

According to one particularly simple and advantageous embodiment, the driving means comprise a driving motor, and the control means comprise an electronic two-state control circuit adapted to deliver to the motor either a signal for driving in the direct direction of the motor corresponding to the state in which the adjustment member is driven in the direct direction, or a signal for braking of the motor corresponding to the braked state of the adjustment member, according to the state of said position signal. In a variant or in combination, the driving means comprise means of engaging/disengaging the adjustment member with respect to the driving movement.

Advantageously and according to the invention, the device according to the invention has means of braking the adjustment member adapted to lock the adjustment member in the braked state. In particular, according to the invention, the control means are adapted to be able to control the stopping of the adjustment member in the braked state.

Advantageously and according to the invention, the guidance device is characterized in that the driving means are adapted to be able also to drive the adjustment member in the retrograde direction which is the reverse of the direct direction.

Advantageously and according to the invention, the device comprises means of prior setting of the orientation angle, so as to allow an initial setting, notably as a function of the nature and characteristics of the material and the forms of the reference line.

In addition, the device according to the invention advantageously comprises means for the prior setting of the position of the adjustment member with respect to the presser foot.

According to one advantageous embodiment, and according to the invention, the guidance device is characterized in that the adjustment member is of the rotary type (wheel) and mounted so as to be free in rotation about an axis and in that the driving means comprise a driving member suitable for being coupled in rotation to the adjustment member at least in the state of being driven in the direct direction, and means for driving this driving member in rotation in the direct direction from a driving movement, at a speed of rotation corresponding to said peripheral speed of the adjustment member.

Advantageously and according to the invention, the driving member is a roller mounted so as to rotate about an axis so as to be able to be disposed in abutment against the adjustment member with a view to driving it in rotation through friction contact. This roller is for example coupled to the motor for driving the adjustment member under two-state control. According to the invention, the roller and the adjustment member are then advantageously adapted to exhibit an inertia in rotation which is sufficiently low not to drive the motor in rotation in the direct direction when a stop signal or a signal for change of direction of rotation is applied to the motor. For example, the roller is made of light alloy, notably aluminum alloy, and has recesses in order to lighten it. In this way the motor is prevented from being driven by inertia when passing to the braked state, which takes place at a high rate (around ten times or more per second). This characteristic is particularly useful in the case of a stepping motor.

The guidance device according to the invention is advantageously applicable for executing an automatic stitching of a piece of material along one of its edges constituting said predefined reference line. It is then characterized in that:

the position detector is a detector for the presence or absence of material, associated with means of generating a position signal with two states representing the presence or absence of material, the control means are adapted to control the driving means alternately from the state of being driven in the direct direction to the braked state or vice versa at each change of state of the position signal. Advantageously and according to the invention, the detector and the adjustment member are disposed so that the point of contact and the detection line are situated on each of the said driving straight line.

In addition, advantageously and according to the invention, the device has means of blowing the material towards the upstream side of the presser foot, disposed so as to be able to apply a stream of air onto the material with an effect opposing the driving of the material induced by the adjustment member in the state in which it is driven in the direct direction. In this way folds in the material which might interfere with the operation of the detector are avoided.

The invention also concerns a sewing machine, notably an automatic industrial sewing machine, for example for joining pieces for finishing necks, sleeves, legs etc, characterized in that it has at least one guidance device according to the invention.

The invention also concerns a method, a guidance device and a machine comprising in combination all or some of the characteristics mentioned above or below.

BRIEF DESCRIPTION OF THE DRAWINGS

Other characteristics, aims and advantages of the invention will emerge from the description which follows with reference to the accompanying drawings which depict, non-limitatively, one of its embodiments, and in which.

DETAILED DESCRIPTION OF THE INVENTION

Figure 1:
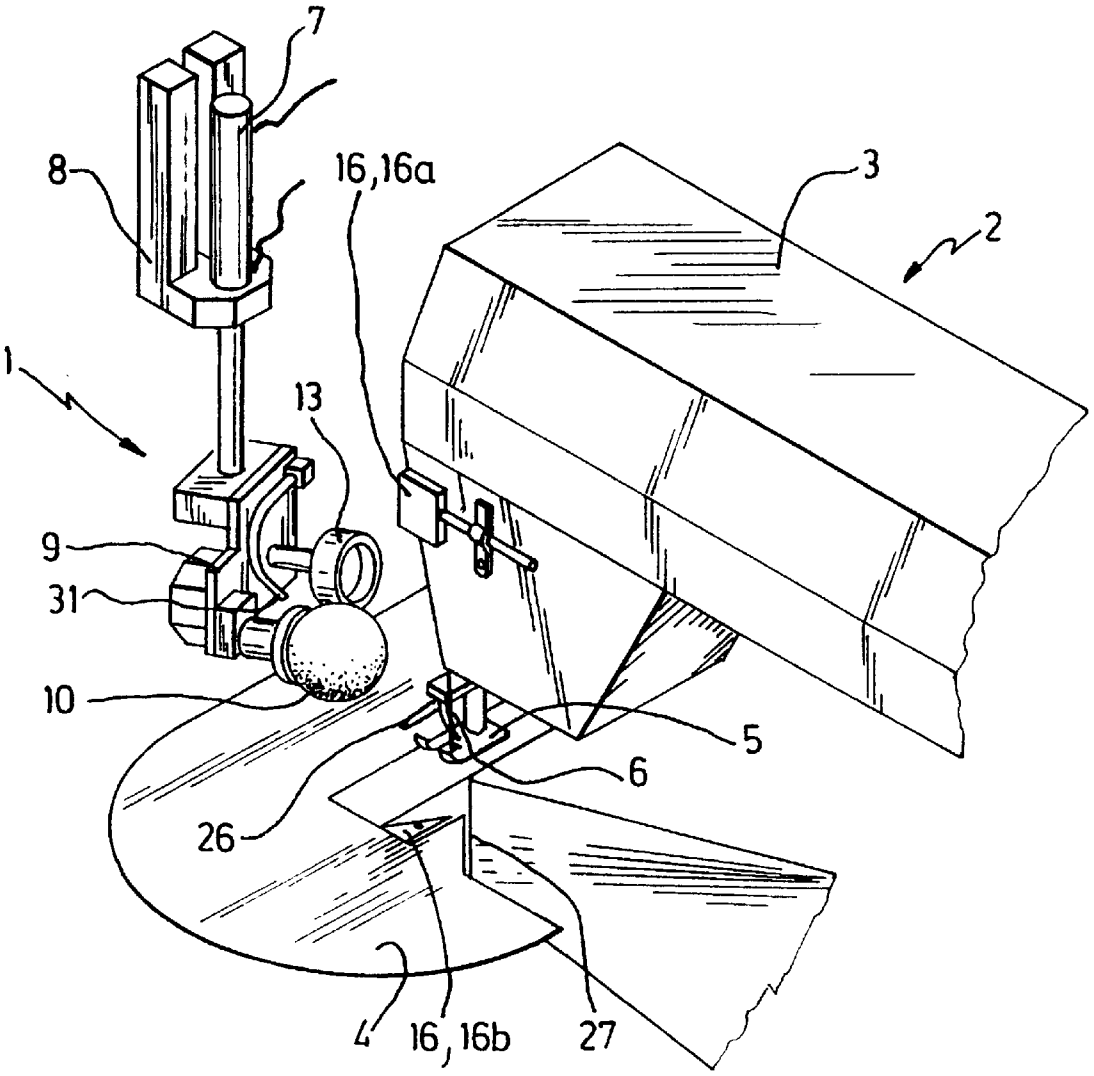
FIG. 1 is a partial schematic view in a perspective view at a first angle of a guidance device and a machine according to the invention.

The guidance device 1 depicted in FIGS. 1 to 8 is mounted on a sewing machine 2 of the type with the head to the left; in a traditional fashion, this machine comprises a frame 3, a work carrier plate 4, a presser foot 5 associated with a needle 6 with their conventional driving kinematics (claw advance mechanism etc), thread distribution means etc. The object of the example referred to is the stitching of an elastic neck tape E at the border of a piece P of knitting or other flexible textile material, and the machine is provided with conventional means of feeding and guiding this elastic tape E towards the stitching zone (not depicted). The presser foot 5 is adapted to drive the piece of material in the longitudinal direction, along a driving straight line 18.

The guidance device according to the present invention is designed to guide the piece of material P which rests on the work carrier plate 4 in order to make it possible, without the aid of an operator, to effect stitching parallel to the edge of material, which can be of high curvature, or even angular, convex or concave.

This guidance device 1 is carried by a pneumatic ram 7 whose body is fixed, by means of a piece 8, to the frame 3 of the machine and whose movable rod is secured by its end to a support bracket 9 of the guidance device. The ram 7 is arranged so as to be able to move the guidance device between a working position in which the latter is applied in contact with the material in order to guide it, and an inactive position in which it is away from the material and from the work carrier plate 4 so as to allow notably the introduction of a new piece of material underneath the presser foot 5.

In the embodiment depicted in the figures, the work carrier plate 4 is formed by a horizontal plate, and the ram 7 extends vertically in order to move the guidance device, downwards, in contact with the material to be guided. It is nevertheless understood that the invention extends to other embodiments, including those in which the work carrier plate 4 could comprise an inclined or vertical portion and in which the guidance device is applied in contact with this portion, the ram 7 then being inclined or even horizontal. Likewise, the guidance device can be positioned underneath the work carrier plate 4, or duplicated in order to effect a simultaneous guidance of two layers of material, one above and the other underneath the plate 4.

The support bracket 9 carries an adjustment member 10 which is mounted and adapted so as, in the working position of the guidance device, to be applied in contact with the material at a point of contact 12. This point of contact 12 is situated above the work carrier plate or, more generally, on a straight line at right angles to the work carrier plate. The application ram 7 applies and continuously holds the adjustment member 10 in contact with the material, that is to say throughout the stitching of the piece P. Advantageously and according to the invention, this adjustment member 10 is of the rotary type and is mounted so as to be free in rotation about a horizontal axis XX', that is to say more generally parallel to the work carrier plate 4. The axis XX' and the adjustment member 10 are carried by the support bracket 9. The adjustment member 10 advantageously consists of a wheel, for example a sphere made of elastic material such as a hollow rubber ball, mounted (for example by bonding a lateral cap on its surface),on a carrier shaft 11 which swivels with respect to a bearing carried by the support bracket 9 so that this spherical wheel 10 is free to turn about the axis XX' which passes through its centre.

Such an adjustment member 10 comes in contact with the material at a point of contact 12 forming part of a circular driving generator situated in a plane perpendicular to the work carrier plate 4 and to the rotation axis XX'.

The support bracket 9 also carries a driving member 13 able to be associated with the adjustment member 10 with a view to driving it in rotation. This driving member 13 is advantageously a roller mounted so as to rotate about a horizontal axis ZZ' parallel to the axis XX' so as to be able to be disposed in abutment against the adjustment member 10 with a view to driving it in rotation by friction contact. The roller 13 is carried by a drive shaft 14 of an electric motor 15, the assembly itself being carried by the support bracket 9.

Advantageously, the motor 15 is an electric motor of the stepping type. When the motor 15 is supplied with electrical energy, it rotates the roller 13 which itself rotates the sphere 10 about its axis XX' by friction contact.

The guidance device according to the invention also comprises an optical detector 16 detecting the predefined reference line which the automatic stitching is to follow. This detector 16 is of the conventional type and comprises a light emitter/sensor unit 16*a* and a reflective insert 16*b* carried by the work carrier plate 4 immediately upstream of the presser foot 5. The light source of the emitter/sensor assembly 16*a* emits a light ray which is reflected by the insert 16*b*. The sensor of the emitter/sensor assembly 16*a* delivers an electrical signal whose value depends on the light intensity reflected by the insert 16*b*. Thus, in the absence of any material opposite this insert 16*b*, the electrical signal is at its maximum, all the light being reflected towards the sensor. When there is material present, the light is absorbed and is not reflected, and the electrical signal delivered by the sensor is at its minimum. Thus the sensor, which is for example a photoelectric cell, delivers an electrical signal whose value varies depending on whether the edge of the material covers the insert 16*b* or on the contrary does not cover it. In this way the detector 16 makes it possible to detect the transverse position of the edge of the piece of material which is to be sewn, this edge constituting the predefined reference line.

The position detector 16 is therefore a detector for the presence or absence of material, and the photoelectric sensor constitutes means of generating a position signal with two states representing the presence and absence of material opposite the insert 16*b*.

With this detector 16, the presence or absence of material is detected at at least one detection zone 16*b* defined by the insert 16*b*, situated immediately upstream and in the vicinity of the presser foot 5, on the expected path of the edge to be detected. The insert 16*b* is preferably disposed as close as possible to the entry 21 to the presser foot 5. Advantageously, the optical detector 16—and more particularly the insert 16*b*—is associated with means of setting its transverse position with a view to making it possible to adjust the position of the stitching with respect to the edge of the material.

The detector 16 makes it possible to detect whether a portion of the edge of the material which passes opposite the detection zone 16*b* is on one side or the other of a line, referred to as the detection line 17, parallel to the driving straight line 18 and which passes through the detection zone 16*b*.

Instead of detecting the presence or absence of the edge of the material to be sewn, it is possible, in a variant which is not shown, to use, with the guidance device according to the invention, a detector for the transverse position of another predefined reference line, for example a reflective line drawn on the piece of material.

Whatever the case, the detector 16 is mounted upstream of the presser foot 5 and is associated with means (a photoelectric cell) of generating a position signal whose value varies depending on whether the point of intersection of the predefined reference line with a straight line at right angles to the detection line 17 and passing through the detection zone 16*b* (that is to say through the reflective insert 16*b*) is on one side or the other of the detection line 17. The position of the point of intersection I in fact represents the transverse position of the edge of the piece of material opposite the detection zone 16*b*, on one side or the other of the detection line 17.

Figure 4:
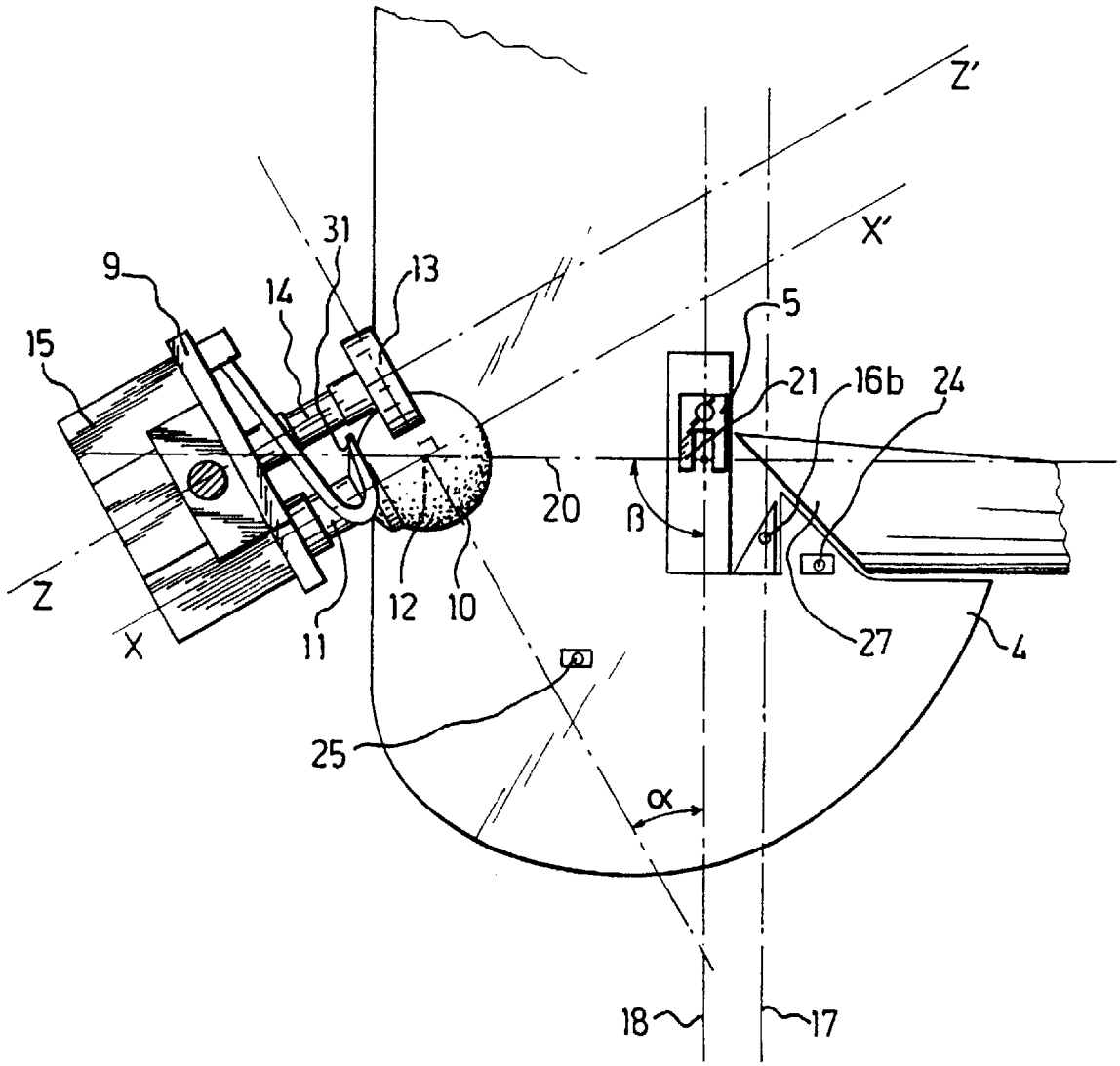
FIG. 4 is a schematic plan view illustrating the position and orientation of an adjustment member for a guidance device according to the invention, in operation.

As can be seen in FIG. 4, the detector 16 and the adjustment member 10 are disposed so that the point of contact 12 and the detection line 17 are situated on each side of the driving straight line 18.

Figure 9:
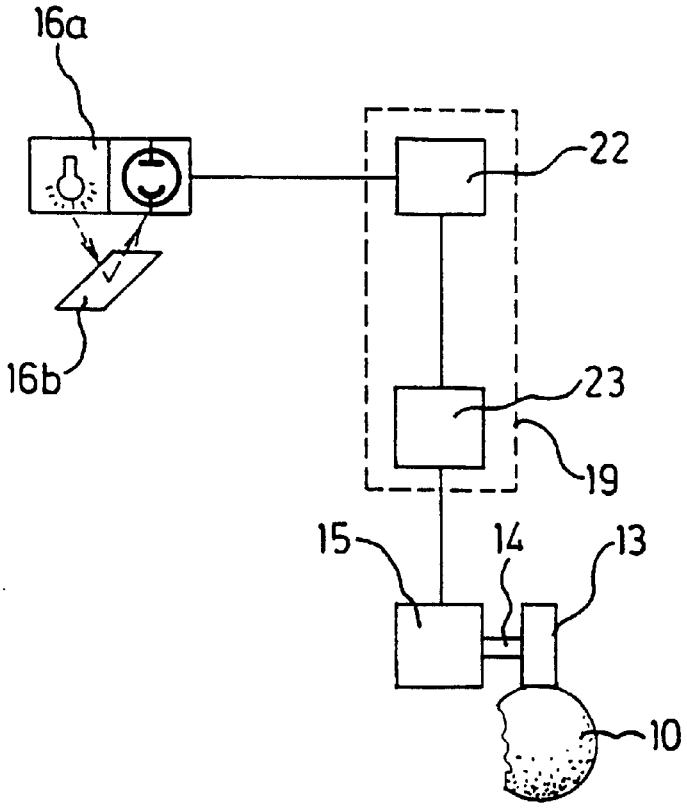
FIG. 9 is a functional diagram of the control means for a guidance device according to the invention.

The signal issuing from the detector 16 is supplied to a control circuit 19 (FIG. 9) of the motor 15.

Figure 5:
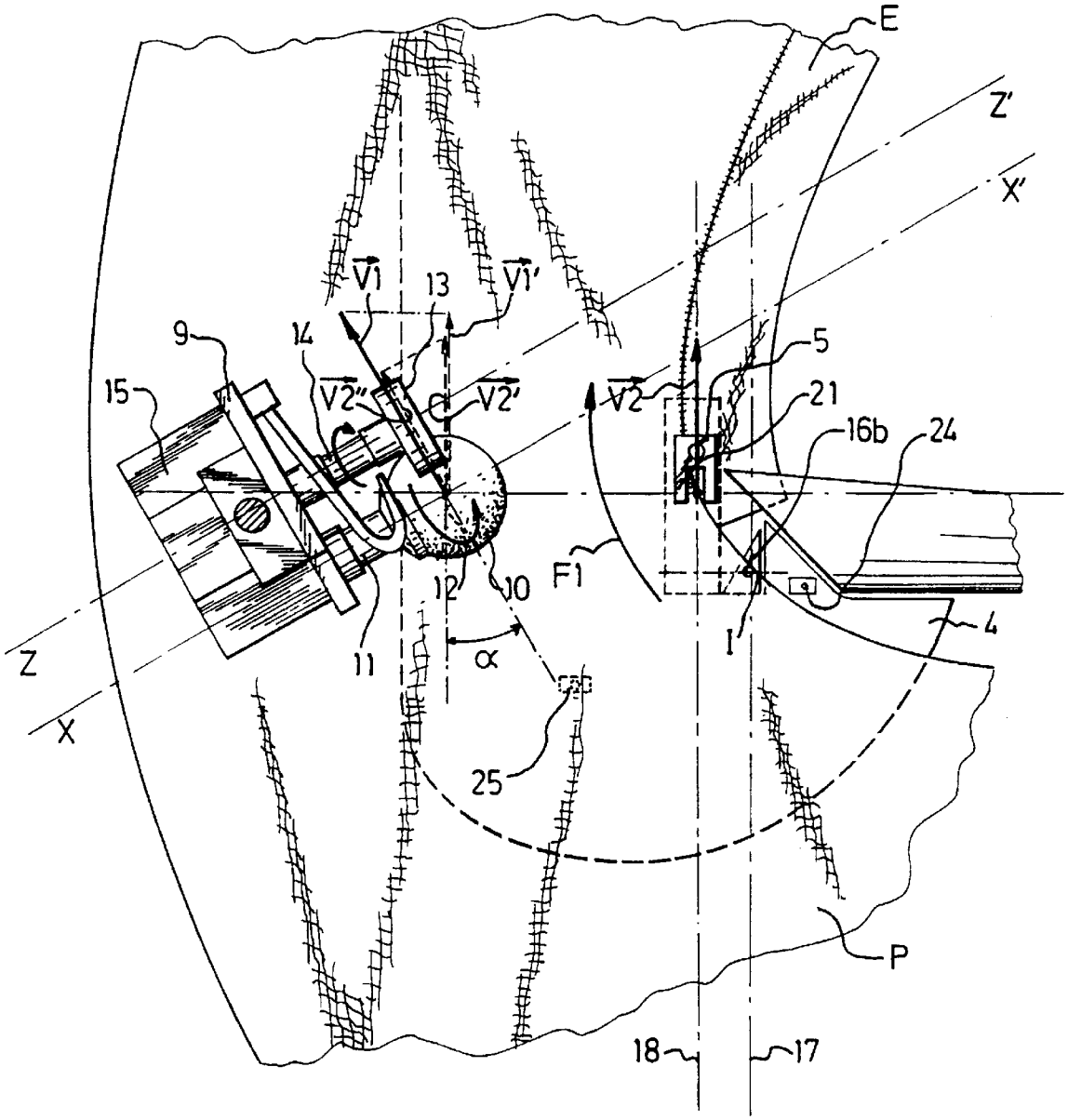
FIG. 5 is a schematic plan view similar to FIG. 4, illustrating the execution of automatic stitching along a concave edge of a piece of material.
Figure 6:
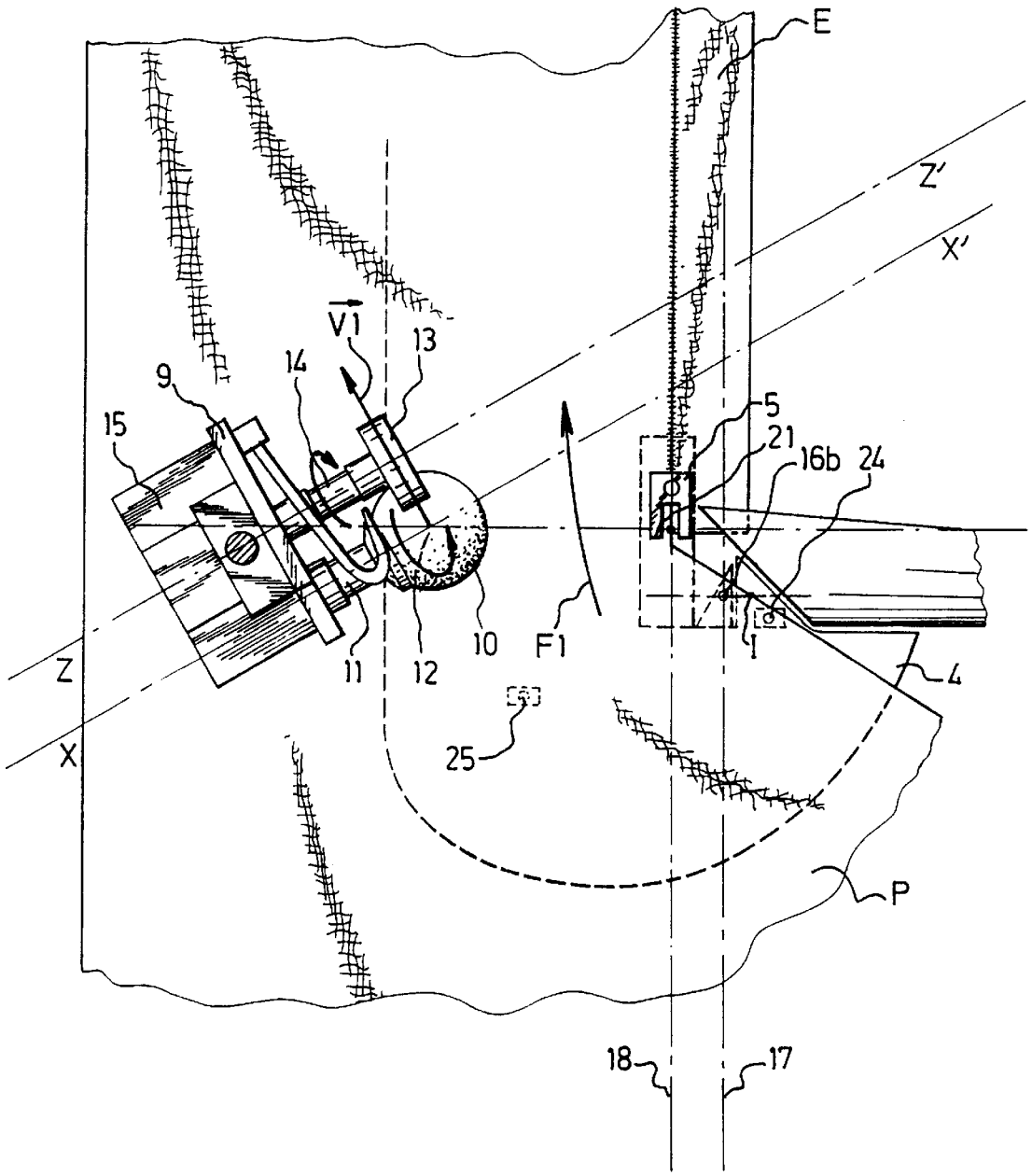
FIG. 6 is a schematic plan view similar to FIG. 4, illustrating the execution of automatic stitching at a concave angle of a piece of material.

The vector V2 represents the speed of driving of the piece of material by the presser foot 5. At the point of contact 12, this driving gives rise to a driving speed represented by the vector V2'. The motor 15 and roller 13 form means of driving the adjustment member 10, and are adapted so as to be able to drive this adjustment member 10 in the direct direction for which the peripheral speed of this adjustment member 10 at the point of contact 12, represented by the velocity vector V1, has a component parallel to the driving straight line 18, represented by the vector V1', which is oriented in the same direction as the direction of driving of the material by the presser foot 5, that is to say in the same direction as the velocity vector V2 of driving of the material by the presser foot 5 (FIGS. 5 and 6). These driving means 13, 15 are also adapted so as to drive the adjustment member 10 in the direct direction at a speed of rotation corresponding to a peripheral speed V1 of this adjustment member 10 whose value is greater than the component represented by the vector V2" of the driving speed V2, at the point of contact 12 and in the direction of the peripheral speed V1. More particularly, at the point of contact 12, the adjustment member 10 driven in the direct direction locally accelerates the material with respect to the speed at which it is driven by the presser foot 5, and this acceleration is sufficient to generate a pivoting torque in the direction of the arrow F1 (FIG. 5).

It should be noted that, for this pivoting in the direction of F1 to be obtained, it suffices for V1' to be greater than V2' in the example depicted in FIG. 5 where the point of contact 12 is in line with the presser foot 5. More generally, it suffices for the components V1', V2' at the point of contact 12 of the peripheral speed V1 of the adjustment member 10 and of the speed of driving V2 by the presser foot 5 along a straight line at right angles to the straight line connecting the point of contact 12 and the presser foot 5, to be such that V1'>V2' (or V1>V2", V2" being the component of V2' in the direction of V1).

Figure 7:
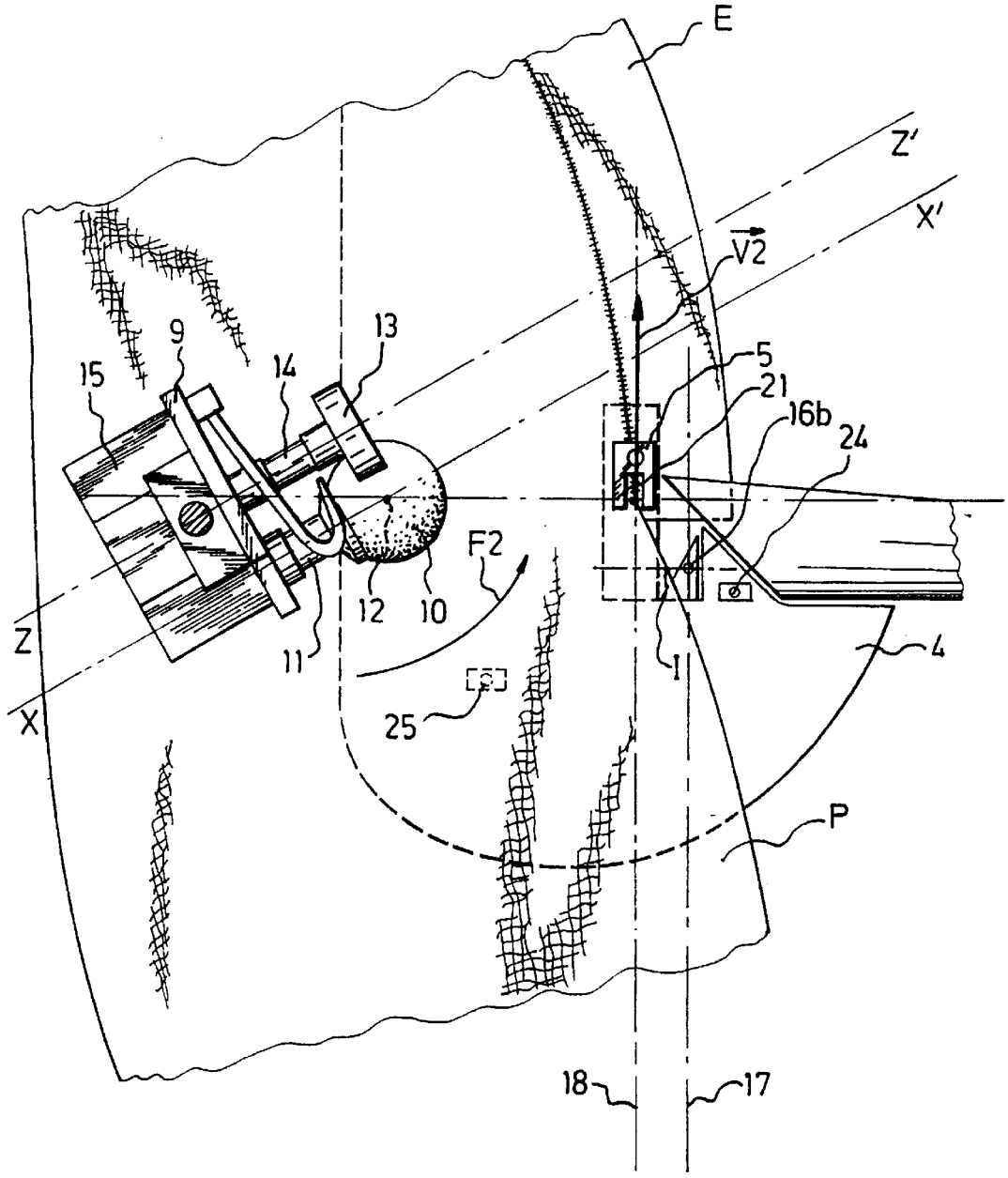
FIG. 7 is a schematic plan view similar to FIG. 4, illustrating the execution of automatic stitching along a convex edge of a piece of material.
Figure 8:
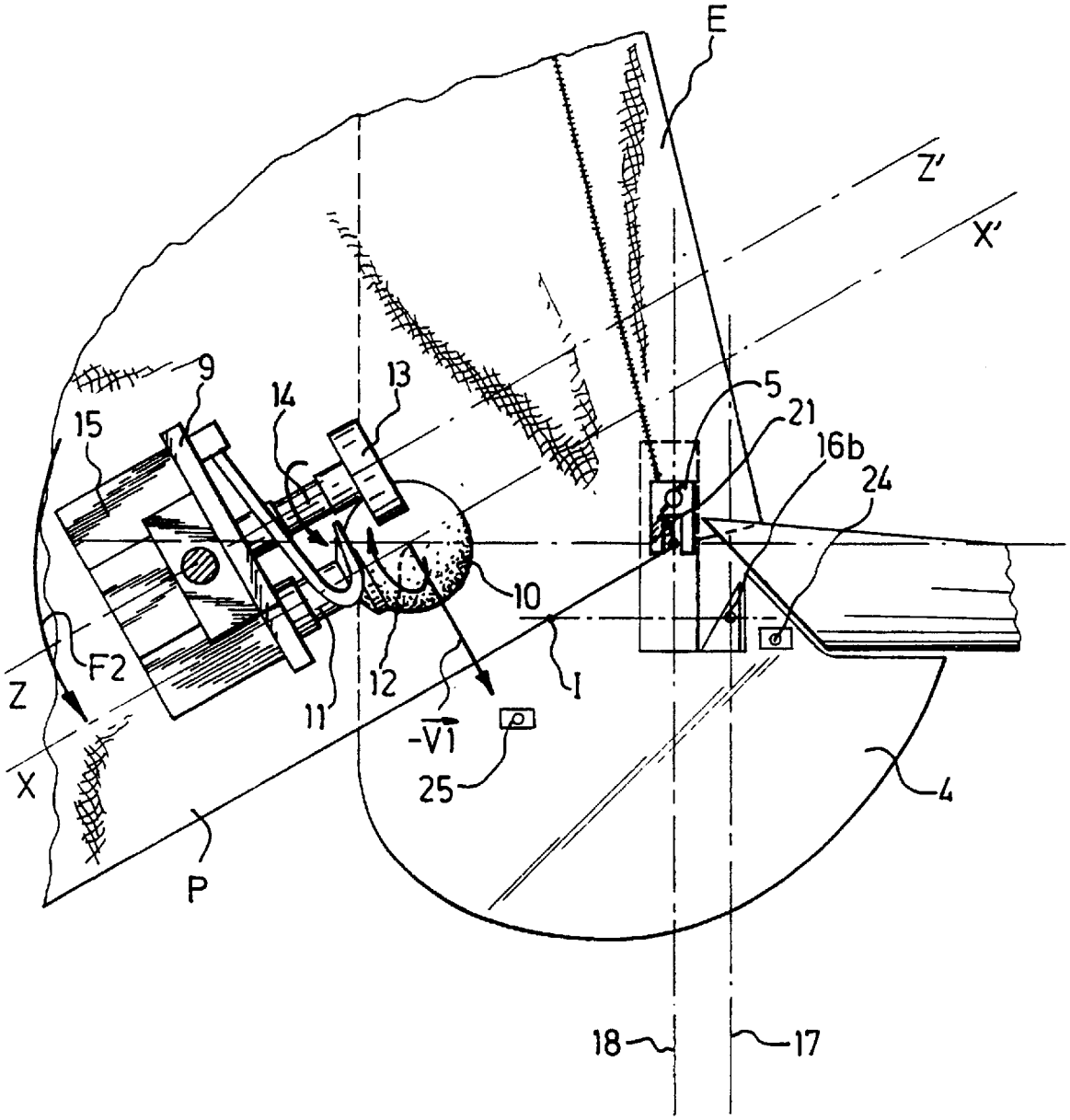
FIG. 8 is a schematic plan view similar to FIG. 4, illustrating the execution of automatic stitching, at a convex angle, of a piece of material.

The motor 15 and roller 13 also form driving means which are adapted to put and maintain the adjustment member 10 either in the state in which it is driven in the direct direction at the peripheral speed V1, or in a state, referred to as the braked state, in which the peripheral speed V1 is less than or in the opposite direction to the component V2" of the speed of driving of the material by the presser foot 5. In the case of the use of a stepping electric motor 15, it suffices for example to send a signal to the motor 15 20 controlling its driving at a lower speed, or even its stoppage or its driving at a speed in the retrograde direction, opposite to the direct direction (FIGS. 7 and 8).

The control circuit 19 is of the two-state type and is adapted to control the driving means 13, 15 as a function of the value of the position signal issuing from the detector 16:

in the state in which the adjustment member 10 is driven in the direct direction when the predefined reference line and the point of contact 12 are on each side of the detection line 17, whereby the material is accelerated at the point of contact 12 by the adjustment member 10, and therefore is pivoted in a direction (arrow F1 in FIGS. 5 and 6) with respect to the work carrier plate 4, in the braked state of the adjustment member 10 when the predefined reference line and the point of contact 12 are situated on the same side of the detection line 17, whereby the material is braked, at the point of contact 12, by the adjustment member 10 and therefore pivoted in the other direction (arrow F2 in FIGS. 7 and 8) with respect to the work carrier plate 4.

In the embodiment depicted and according to the invention, when the insert 16*b* of the detector 16 is covered with material, the sphere 10 is rotated in the direct direction, which tends to accelerate the material (FIG. 5). On the other hand, when the insert 16*b* is uncovered (FIG. 7), the control circuit 19 puts the motor 15 in the braked state, which tends to brake the material at the point of contact 12 and to cause it to pivot in the direction of covering of the insert 16*b*. As stitching takes place, the position signal very rapidly changes state, since the edge of the material is always at least substantially vertically above the insert 16*b*. The sphere 10 is therefore forced at a high frequency to the state of driving in the direct direction and to the braked state alternately. This frequency of change of state may attain a high value, notably greater than 10 hertz.

The adjustment member 10 is mounted so that the point of contact 12 is offset laterally from the driving straight line 18 and so that, in operation, its peripheral speed V1 at the point of contact 12 keeps a fixed orientation. More generally, the plane perpendicular to the work carrier plate 4 which contains the direction of the peripheral speed V1 at the point of contact 12, forms with a plane perpendicular to the work carrier plate 4 and parallel to the driving straight line 18 a non-zero fixed orientation angle $\alpha$ (FIG. 4) less than 90°. This fixed angle a is also the angle which is formed by the axis XX' with respect to the straight line 20 perpendicular to the driving straight line 18. According to the invention, this orientation angle $\alpha$ is non-zero, so that the sphere 10 tends to stretch the piece of material laterally in the state in which it is driven in the direct direction. According to the invention, this orientation angle $\alpha$ is advantageously greater than 20° and less than 45°. For example, it is around 40°.

The piece 8 associated with the frame 3 of the machine and carrying the ram 7 is provided with means of prior setting of the orientation angle $\alpha$, that is to say it is mounted so as to be able to be rotated about a vertical axis with respect to the frame of the machine. Nevertheless, in operation, this orientation angle $\alpha$ remains fixed and the piece 8 is locked in position by any suitable means. In a variant, these setting means can be provided between the support bracket 9 and the rod of the ram 7.

In addition, according to the invention, the adjustment member 10 is mounted so that the point of contact 12 is situated, in operation, at least substantially in line with the presser foot 5. In other words, a plane perpendicular to the work carrier plate 4 and to the driving straight line 18 and which contains the point of contact 12, passes through the presser foot 5.

More particularly, the adjustment member 10 is mounted so that a plane perpendicular to the work carrier plate 4 which contains a straight line passing through the point of contact 12 and through the entry 21 to the presser foot 5 forms an angle $\beta$ of around 90° with a plane perpendicular to the work carrier plate 4 which contains the driving straight line 18 (FIG. 4).

If the angle $\beta$ is appreciably less than 90°, the efficacy of the guidance device in the braked state is reduced or even negated. This is because the presser foot 5 tends very rapidly to exert a traction incompatible with the braking of the material at the point of contact 12. Likewise, if the angle $\beta$ is appreciably greater than 90°, and notably as from approximately 100°, the guidance device is no longer effective in the state of driving in the direct direction since the acceleration of the material occurs downstream of the presser foot 5, at a point which does not allow pivoting of the piece.

Thus, contrary to the state of the prior art in which it was sought to guide and adjust the transverse position of the piece of material immediately upstream of the presser foot 5 and at a zone at least substantially situated in line with the driving straight line, the guidance device according to the invention is placed at least substantially in line with the entry 21 to the presser foot 5 and reaches its maximum efficacy in this position. In this way, it is possible to produce both concave (FIGS. 5 and 6) and convex (FIGS. 7 and 8) stitches with great efficacy and great precision in guidance.

The device according to the invention advantageously has means 28, 29, 30 of adjusting the position of the point of contact 12 with respect to the presser foot, and notably means 28, 29, 30 of adjusting the angle $\beta$. For example, the piece 8 carrying the vertical ram 7 and the support bracket 9 can be mounted with respect to the frame 3 of the machine by means of a system with horizontal slides 29 fixed to the piece 8 and with a threaded rod 28 fixed to this frame 3, the position of the piece 8 along the rod 28 being able to be adjusted for example by nuts 30 (one on each side of the piece 8 in order to lock it).

The slides 29 and rod 28 extend parallel to the direction of driving of the material by the presser foot 5, so that these means 28, 29, 30 make it possible to adjust the position of the point of contact 12 parallel to this direction.

In addition, in the case of pieces whose cut does not make it possible to reach, from the very start of the stitching, the point of contact 12 with the adjustment member 10 in the position in line with the presser foot, the device according to the invention has means (not shown) for moving the support piece 8 towards the upstream side before the start of the stitching and of the driving by the presser foot so that the adjustment member 10 comes into contact with the cloth. These means are also adapted to move the support piece 8 once again downstream, simultaneously with the starting of the stitching, at a speed slightly less than the speed of driving V2 by the presser foot until the adjustment member 10 returns to its normal position substantially in line with the presser foot. These movements can be obtained simply by virtue of a double-acting horizontal pneumatic ram (not shown) mounted on the frame so as to move the support piece 8 horizontally and at least substantially parallel to the direction of driving.

The control circuit 19 comprises a two-state electronic control circuit 22 which receives the position signal delivered by the detector 16, analyzes this signal in order to determine whether it corresponds to a presence or absence of material (by comparing the analogue electrical signal received with a threshold), and produces a signal with two states corresponding respectively to the state of driving in the direct direction and the braked state of the adjustment member 10. Thus this electronic control circuit 22 delivers either a signal for driving the motor 15 in the direct direction able to put the adjustment member 10 in the state of being driven in the direct direction, or a signal for braking the motor 15 able to put the adjustment member 10 in the braked state, depending on the state of the position signal delivered by the detector 16.

The signal delivered by the control circuit 22 is supplied to a control card 23 for the stepping motor 15. This control card 23 produces and supplies to the motor 15 an electrical supply (in the form of pulses with a frequency proportional to the desired speed of rotation) corresponding to the state determined by the control circuit 22, in which the adjustment member 10 is to be put.

According to one variant of the invention, the control circuit 19 receives a signal representing the value of the speed V2 of driving of the material by the presser foot 5, and the control card 23 is adapted to deliver a signal for driving in the direct direction such that the value of the peripheral speed V1 of the adjustment member 10 is in a constant ratio with the driving speed V2. In this way it can be ensured that V1'>V2' whatever the value of V2, which can optionally be adjustable and can vary.

Advantageously and according to the invention, notably in the case of borders of pieces the major part of which has a small curvature, this constant ratio is chosen so that V1' is little greater than V2' (V1 little greater than V2").

Such a two-state control logic is extremely simple to produce. For example, the signal for driving in the direct direction corresponds to a driving of the motor 15 at maximum speed in the direct direction, and the braking signal corresponds to a signal for stopping the motor 15.

In a variant or in combination, the means of driving the adjustment member 10 can comprise means of engaging/disengaging the adjustment member 10 with respect to a driving movement. Thus it is possible to use the main motor of the sewing machine to drive the adjustment member 10 and provide a clutch/brake device in the transmission kinematics. For example, a clutch/brake with electrical control can be provided on the rotary shaft 14 carrying the roller 13, this clutch/brake device on the one hand receiving the driving movement and on the other hand transmitting it or not to the shaft carrying the roller 13.

According to another variant, it is also possible to drive the roller 13 at a constant nominal speed and to move the adjustment member 10 with respect to the driven roller, either into a position in which it is engaged in contact with the roller 13, or into a position in which it is distant from the roller 13 and disengaged. In the disengaged state, the adjustment member 10 can also be applied in contact with a fixed part in order to brake it. For example, the shaft 11 which carries the sphere 10 can be mounted at the end of the actuating rod of a horizontal ram carried by the support bracket 9.

Equally, it is advantageous to be able to drive the adjustment member 10 in the retrograde direction opposite to the direct direction, notably in order to produce stitchings in a convex angle (FIG. 8). The control circuit 19 is then adapted to be able to put the adjustment member 10 into a state, referred to as the state of driving in the retrograde direction, in which it is driven in the retrograde direction by the driving means 13, 15.

Thus, according to the invention, the braked state of adjustment member 10 encompasses notably the following states:

the state simply disengaged from the driving movement which drives in the direct direction (variant, not shown, with engagement/disengagement), state locked in rotation and stopped, state driven in the retrograde direction.

The roller 13 and the adjustment member 10 are adapted to exhibit as low an inertia as possible, and notably an inertia in rotation which is sufficiently low not to drive the motor 15 by inertia in rotation in the direct direction when a signal for stopping or rotation in the retrograde direction, or more generally a signal for changing direction of rotation, is applied to the motor 15. It is in fact necessary to prevent the motor 15, notably in the case of a stepping motor, losing its reference in rotation because of the inertia in rotation of the roller 13 and/or the sphere 10. Advantageously, the roller 13 is made from light alloy, notably aluminum alloy, and/or provided with apertures and recesses in order to lighten it.

Figure 2:
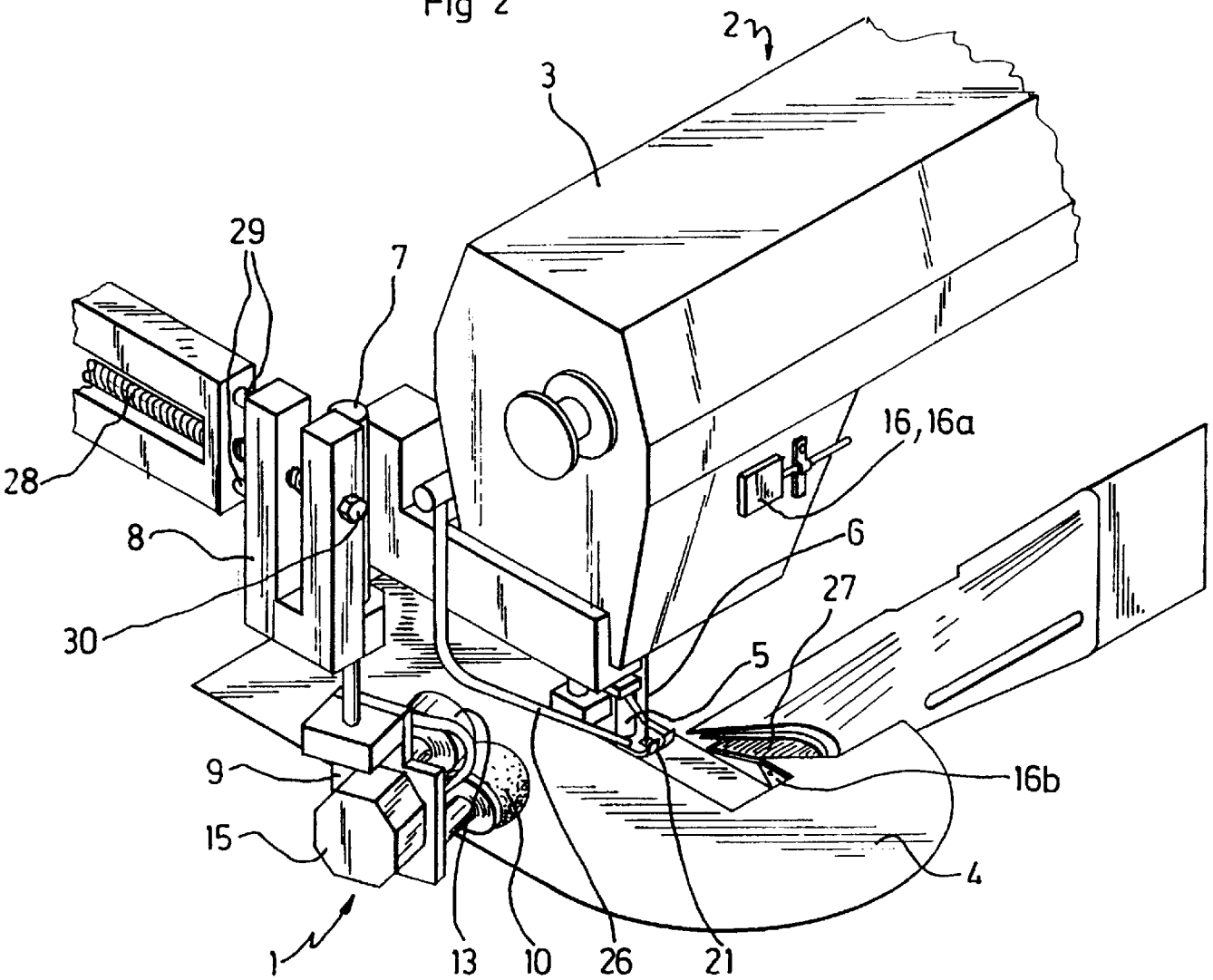
FIG. 2 is a partial schematic view in a perspective view at a second angle of a guidance device and a machine according to the invention.
Figure 3:
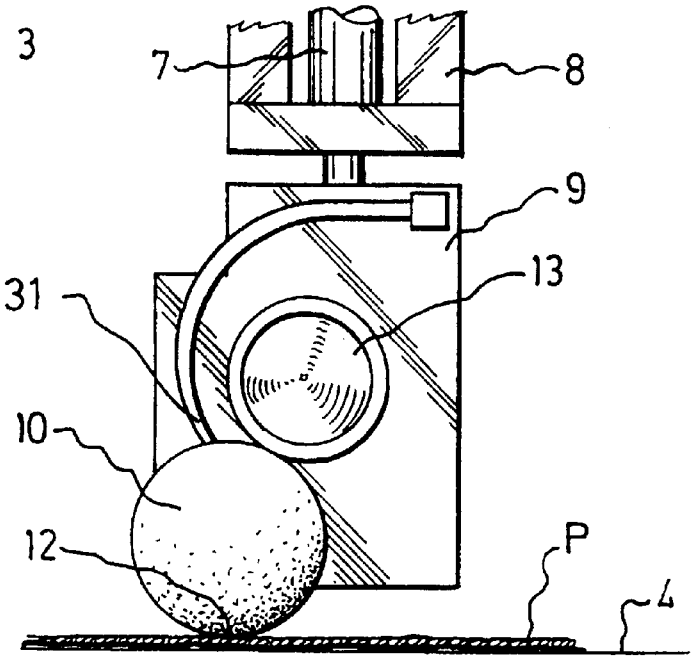
FIG. 3 is a partial schematic view in elevation of a guidance device according to the invention in the operating position.

The guidance device also has means 26 for blowing material towards the upstream of the presser foot 5, disposed so as to be able to apply a stream of air on the material with an opposing effect to the driving of the material induced by the adjustment member 10 in the state in which it is driven in the direct direction. Thus FIGS. 1 and 2 depict a nozzle 26 for blowing compressed air which opens out immediately upstream of the presser foot 5 and blows a stream of air towards the upstream in a direction substantially parallel to that of the velocity V1 (angle $\alpha$ with respect to the direction of driving) in order to stretch the material before it enters the presser foot 5. This stream of air tends to unroll the border of the material, to press it onto the plate 4, and to stretch the portion of the material upstream of the presser foot in the direction opposite to the one in which the material is driven by the sphere 10 at the point of contact 12. Any rubbing and folding which could impair the reliability of the detection of the edge by the detector 16 are thus prevented. Equally a blowing nozzle 31 is designed to open out between the shafts 11, 14 carrying the roller 13 and sphere 10, so as to stretch the material immediately downstream of the point of contact 12 in the direction of the peripheral speed V1 of driving by the sphere 10. In this way blockages and folding each time the sphere 10 begins to rotate in the direct direction are avoided.

In addition, a lateral suction orifice 27 is disposed on the side of the entry 21 to the presser foot, opposite to the adjustment member 10. This orifice 27 is situated on the side of the detection insert 16*b*, and makes it possible to press the edge of the material on this insert 16*b*, preventing folds. If necessary (a variant which is not shown), a guide, for example in the form of a stirrup with an opening oriented laterally towards the insert 16*b*, can be provided immediately on the side of the insert 16*b* in order to improve the precision of the guidance of the edge of the material opposite the insert 16*b*.

The minimum radius of curvature which can be achieved automatically by the guidance device of the invention depends on the difference between the peripheral speed V1 of driving the sphere 10 in the direct direction and the speed V2 of driving the presser foot 5 as explained above, as well as the distance between the point of contact 12 and the presser foot 5. Nevertheless, it is possible to achieve concave radii of curvature which are as small as possible, or even concave angles, by reducing the speed V2 of driving by the presser foot 5, or even by stopping this driving. To do this, the value of the speed V1 of the sphere 10 is not made to depend on that of the driving speed V2.

In the embodiment depicted in FIG. 5, the device is provided with a second optical detector 24, similar to the detector 16, and which is situated on the opposite side of the detection line 17 with respect to the adjustment member 10. The function of this second detector 24 is to detect the presence of the edge of the piece of material P in the case of concave curves with an extremely pronounced or angular curvature. If this detector 24 is covered with material, it transmits a corresponding signal to a circuit controlling the speed of driving V2 of the presser foot 5, and this control circuit reduces or cancels the speed V2. Thus, if the peripheral speed V1 of driving in the direct direction does not suffice to cause the piece of material P to pivot by a sufficient amount in the direction of the arrow F1 to uncover the insert 16*b* (FIG. 6), the edge of the piece of material will cover the second detector 24, which has the effect of actuating the stoppage or the reduction of the speed V2 of driving by the presser foot 5. Consequently the pivoting can be entirely effective until this second detector 24 is once again uncovered. This is particularly advantageous for concave piece borders with acute angles.

As a variant or in combination, the state of being driven in the direct direction encompasses notably not only a state of being driven in the direct direction at a nominal speed V1 little greater than V2" (or V1' little greater than V2'), but also a state of being driven in the direct direction at a high speed at a velocity V1 very much greater than V2", for example around twice or three times V2". Thus, as a variant or in combination with the stoppage or reduction in the speed V2, the adjustment member 10 can be controlled to the state of being driven in the direct direction at high speed when the second detector 24 is covered. This is particularly advantageous in the case of concave piece borders with obtuse angles. To do this, it suffices to supply the stepping motor 15 with signals at a higher frequency, for example twice or three times the frequency demanding nominal speed. Thus, in the state driven in the direct direction, the value of the peripheral speed V1 is not always the same, and may vary between various values. The same applies to the ratio between the value of the peripheral speed V1 of the adjustment member 10 and that of the driving speed V2.

The same arrangement can be provided in the direction of the convex curves. Thus for example FIG. 8 depicts a third detector 25 which, when it is uncovered, transmits a signal to the circuit controlling the speed V2 which stops or brakes the driving by the presser foot 5, so that the piece of material can be pivoted in the direction of the arrow F2 by driving the sphere 10 in the retrograde direction until its edge comes to cover this third detector 25 once again. It is easy to understand that the radius of curvature of the convex curves which can be obtained automatically can be extremely small or even angular by virtue notably of such a detector 25.

In addition, by driving the sphere 10 in the retrograde direction, there is a further reduction in the radii of curvature which can be achieved without modifying the speed of driving of the presser foot 5.

FIGS. 5 to 8 illustrate different examples of automatic stitchings which can be produced on a machine according to the invention, as well as different states of operation of the adjustment member 10.

In FIG. 5, a stitching is being carried out along a concave edge of high curvature of the piece P by sewing the piece E, which is for example a neck piece for a round neck. In the state depicted, the insert 16*b* is covered and the point I of intersection between the edge of the material and a straight line which passes through the detection zone 16*b* and which is perpendicular to the detection line is on the opposite side to the point of contact 12 with respect to the detection line 17. The adjustment member 10 is then driven in the direct direction at the peripheral speed V1. The second detector 24 is not covered, so that the presser foot is driven at its normal speed V2, giving rise to a speed V2' of the material at the point of contact 12 (if $\beta=90°$, and if driving takes place normally V2=V2"), whose component V2" in the direction of V1 is such that V1>V2". The peripheral speed V1 of the adjustment member 10 has a component V1' in the driving direction which is oriented downstream, that is to say in the same direction as the speed V2 of driving by the presser foot 5. The piece P tends to pivot in the direction of the arrow F1 until the insert 16*b* is uncovered, as a result of which the adjustment member 10 will be put in the braked state, for example by stopping the motor 15.

In FIG. 7, stitching is carried out along a convex edge. In the state depicted, the insert 16*b* is uncovered, and the said point I of intersection is on the same side of the detection line 17 as the point of contact 12, the adjustment member 10 being in the braked state with V1=0. The presser foot 5 drives the material at the speed V2, which causes a pivoting in the direction of the arrow F2 tending to cover the insert 16*b*.

In the example in FIG. 6, stitching is carried out along a concave angle (for example a V neck). The edge of the material coming to cover the second detector 24, driving by the presser foot 5 is interrupted (V2=0). The insert 16*b* being covered, the adjustment member 10 is in the state in which it is driven in the direct direction at the speed V1, which gives rise to a pivoting in the direction of the arrow F1. As soon as the detector 24 is uncovered, driving by the presser foot at the speed V2 will be reactivated. In a variant which is not shown, the second detector 24 can be replaced by several distinct detectors, for example one detector for stopping driving and the other for its resumption.

In the example in FIG. 8, stitching is carried out along a convex angle. The third detector 25 being uncovered, driving by the presser foot 5 is interrupted, and the adjustment member 10 is driven in the retrograde direction at the speed −V1 in order to improve the efficacy of the pivoting in the direction of the arrow F2.

The invention makes it possible in particular to carry out automatic stitching at a high rate with great precision of stitching and with any radii of curvature, notably very small ones. It is in particular applicable to the automatic fitting of neck pieces E and then makes it possible to produce V-necks or necks with a small radius of curvature.

The invention can be the subject of various variants based on the embodiments described and depicted. In particular, the adjustment member disposed in line with the presser foot can be produced in the form of a circular wheel, an endless band etc, and come into contact with the material at several points of contact, or even at a surface area of contact (which is offset laterally and at least substantially in line with the presser foot). Equally, several adjustment members can be provided (for example one in the direct direction, one in the retrograde direction, or one on each side of the presser foot and the driving straight line 18 etc). Equally, the invention is applicable to a sewing machine with a head to the left or a head to the right.

The invention is also applicable with other embodiments of the driving means and of the means of controlling the adjustment member.

What is claimed is:

1. A guidance device for guiding flexible textile material on a sewing machine provided with a work carrier plate, and a presser foot, the material being driven in a longitudinal driving direction and being associated with at least one needle, the guidance device comprising:

at least one adjustment member for adjusting the transverse position of the material, mounted so as to rotate and so as to be able to come into contact with the material, and adapted to be able to locally modify the speed of driving of the material when the adjustment member is applied to the material, said adjustment member moving along a path with a direction and velocity that define a peripheral velocity vector;

application means for applying the adjustment member continuously in contact with the material at a point of contact offset laterally from a driving straight line, passing through the presser foot and parallel to the longitudinal direction of driving, wherein the application means are arranged and the adjustment member is mounted so that:

said point of contact is situated, in operation, along a line that extends substantially perpendicular to a side edge of the presser foot, in operation, a plane perpendicular to the work carrier plate at the point of contact and which extends along a direction corresponding to that of the peripheral velocity vector of the adjustment member at the point of contact, forms, with a plane perpendicular to the work carrier plate at the point of contact and parallel to the driving straight line, a non-zero fixed orientation angle.

2. The device according to claim 1, wherein the orientation angle is less than 90°.

3. The device according to claim 1, wherein the orientation angle is between 20° and 45°.

4. The device according to claim 1, including means for prior setting of the orientation angle.

5. The device according to claim 1, wherein the adjustment member is mounted so that a plane perpendicular to the work carrier plate which contains a straight line passing through the point of contact and through an entry to the presser foot forms an angle of around 90° with a plane perpendicular to the work carrier plate which contains the driving straight line.

6. The device according to claim 1, for executing automatic stitching of the material parallel to a predefined reference line comprising:

driving means for driving, from a driving movement generated by a motor, the adjustment member in rotation at least in one direct direction for which the peripheral velocity vector of the adjustment member at the point of contact has a component in the driving direction which is oriented in the direction of driving of the material by the presser foot, a detector detecting the transverse position of the predefined reference line, mounted upstream of the presser foot, and associated with means for generating a position signal whose value varies depending on whether said predefined reference line is on one side or the other of a straight detection line passing through the detector and parallel to the driving straight line, wherein the driving means are adapted to drive the adjustment member in said at least one direct direction at a peripheral speed of the adjustment member at the point of contact, which peripheral speed is greater than the component at the point of contact and in the direction of the peripheral speed of the speed of driving of the material by the presser foot, the driving means for driving the adjustment member are adapted to put and maintain the adjustment member in one of the following states: a driven state, in which the adjustment member is driven at the peripheral speed in the direct direction by the driving means; and a braked state, in which the peripheral speed is less than or in the opposite direction to the component of the speed of driving of the material by the presser foot, and the device has control means adapted to control the driving means as a function of the value of the position signal:

in the driven state when the point of contact and the predefined reference line are on each side of the detection line, whereby the material is accelerated, at the point of contact, by the adjustment member and therefore driven pivotally in a direction with respect to the work carrier plate, in the braked state when said point of contact and said predefined reference line are situated on the same side of the detection line, whereby the material is braked, at said, point of contact, by the adjustment member and therefore driven pivotally in the other direction with respect to the work carrier plate.

7. The device according to claim 6, further comprising means for braking the adjustment member adapted to lock the adjustment member in the braked state.

8. The device according to claim 6, wherein the driving means are adapted to drive the adjustment member in a retrograde direction opposite to the direct direction.

9. The device according to claim 6, wherein the driving means comprise a driving motor, and said control means comprise a two-state electronic control circuit adapted to deliver either a signal for driving the motor in the direct direction corresponding to the driven state, or a signal for braking the motor corresponding to the braked state of the adjustment member, depending on the state of said position signal.

10. The device according to claim 6, wherein the adjustment member is rotary and mounted so as to be free in rotation about an axis and the driving means comprise a driving member suitable for being coupled in rotation to the adjustment member at least in the driven state, and means for driving said driving member in rotation in the direct direction from a driving movement, at a speed of rotation corresponding to the peripheral speed of the adjustment member.

11. The device according to claim 10, wherein the driving member is a roller mounted so as to rotate about an axis so as to be able to be disposed in abutment against the adjustment member for driving said adjustment member in rotation by friction contact.

12. The device according to claim 9, wherein the roller is coupled in rotation to said motor and the roller and adjustment member are adapted to exhibit an inertia in rotation which is sufficiently low so as to not drive the motor in rotation in the direct direction when a signal for stoppage or change of direction of rotation is applied to the motor.

13. The device according to claim 12, wherein the roller is made of light alloy.

14. The device according to claim 6, for automatically stitching a piece of material along one of its edges constituting said predefined reference line, wherein:

the position detector detects the presence or absence of material, and is associated with means for generating a position signal with two states representing the presence or absence of material, the control means are adapted to control the driving means alternately from the driven state to the braked state or vice versa depending on the state, and at each change of state of the position signal.

15. The device according to claim 1, further comprising blowing means for blowing material towards the upstream of the presser foot, said blowing means being disposed so as to be able to apply a stream of air onto the material with an opposing effect to the driving of the material induced by the adjustment member in the driven state.

16. A sewing machine having at least one guidance device as claimed in claim 1.

17. A method for automatically stitching a piece of flexible textile material on a sewing machine provided with a work carrier plate, a needle, and a presser foot, the method comprising:

providing at least one adjustment member for adjusting the transverse position of the material, said adjustment member being mounted so as to rotate and so as to be able to come into contact with the material, and adapted to be able to locally modify the speed of driving of the material when the adjustment member is applied to the material, said adjustment member moving along a path with a direction and velocity that define a peripheral velocity vector;

applying said rotary adjustment member continuously in contact with the material at at least one point of contact on the material offset laterally from a driving straight line passing through the presser foot and parallel to the longitudinal driving directions;

wherein in operation, the point of contact is situated along a line that extends substantially perpendicular with the presser foot, and a plane perpendicular to the work carrier plate at the point of contact which extends along a direction corresponding to that of the peripheral velocity vector of the adjustment member at the point of contact, forms, with a plane perpendicular to the work carrier plate at the point of contact and parallel to the driving straight line, a non-zero fixed orientation angle.

18. The method according to claim 17, wherein the orientation angle is less than 90°.

19. The method according to claim 17, wherein the orientation angle is between 20° and 45°.

20. The method according to claim 17, wherein the adjustment member is applied at a point of contact situated so that a plane perpendicular to the work carrier plate which contains a straight line passing through the point of contact and through an entry to the presser foot forms an angle of around 90° with a plane perpendicular to the work carrier plate which contains the driving straight line.

21. The method according to claim 17, in which the transverse position of a predefined reference line of the material is detected in a detection area upstream of the presser foot and a position signal is generated whose value varies according to whether the predefined reference line is on one side or the other of a straight detection line passing through the detection area and parallel to the driving straight line, wherein:

the adjustment member is put and maintained in one of the following two states, depending on the value of the position signal: a driven state of rotation in a direct direction, and a braked state;

in the driven state, the adjustment member is driven at a speed corresponding to a peripheral speed of the adjustment member at the point of contact which is greater than a component, at the point of contact and in a direction of the peripheral speed, of the speed at which the material is driven by the presser foot, in the braked state, the driving of the adjustment member is controlled so that the peripheral speed is less than or in the opposite direction to said component of the speed at which the material is driven by the presser foot, the adjustment member is put and maintained in the driven state when the point of contact and the predefined reference line are on each side of the straight detection line, whereby the material is accelerated, at the point of contact, by the adjustment member, and therefore driven pivotally in a direction with respect to the work carrier plate, and the adjustment member is put and maintained in the braked state when the point of contact and the predefined reference line are situated on the same side of the detection line, whereby the material is braked, at the point of contact, by the adjustment member, and therefore driven pivotally in an other direction with respect to the work carrier plate.

22. The method according to claim 21, wherein the adjustment member is locked in order to stop it in the braked state.

23. The method according to claim 22, for automatically stitching the piece of material along one of its edges constituting the predefined reference line, wherein:

the presence or absence of material is detected at at least one detection zone situated immediately upstream of the presser foot, on a predicted path of the edge to be detected, a position signal is generated with two states representing the presence or absence of material, the change of state of the adjustment member is controlled alternately from the driven state to the braked state, or vice versa according to the state and at each change of state of the position signal.

* * * * *